US009964311B2

(12) United States Patent
Behle et al.

(10) Patent No.: US 9,964,311 B2
(45) Date of Patent: May 8, 2018

(54) CLEANING SYSTEM AND METHOD WITH AIR FLUSHING OF DETERGENT/RINSE PIPES

(71) Applicant: Convotherm Elektrogerate Gmbh, Eglfing (DE)

(72) Inventors: Martin Behle, Remscheid (DE); Lutz Riefenstein, Weilhem I. OB (DE); Hannes Wild, Riegsee (DE); Guenter Wurdinger, Peibenberg (DE)

(73) Assignee: CONVOTHERM ELEKTROGERAETE GMBH, Eglfing (DE)

( * ) Notice: Subject to any disclaimer, the term of this patent is extended or adjusted under 35 U.S.C. 154(b) by 0 days. days.

(21) Appl. No.: 14/389,649

(22) PCT Filed: Dec. 14, 2012

(86) PCT No.: PCT/IB2012/002717

§ 371 (c)(1),
(2) Date: Sep. 30, 2014

(87) PCT Pub. No.: WO2013/150330

PCT Pub. Date: Oct. 10, 2013

(65) Prior Publication Data

US 2015/0059807 A1 Mar. 5, 2015

Related U.S. Application Data

(60) Provisional application No. 61/619,167, filed on Apr. 2, 2012.

(51) Int. Cl.

| | |
|---|---|
| ***F24C 14/00*** | (2006.01) |
| ***B08B 9/08*** | (2006.01) |
| ***B08B 9/032*** | (2006.01) |

(52) U.S. Cl.
CPC ..... *F24C 14/005* (2013.01); *B08B 9/032* (2013.01); *B08B 9/08* (2013.01)

(58) Field of Classification Search
None
See application file for complete search history.

(56) References Cited

U.S. PATENT DOCUMENTS 5,499,577 A * 3/1996 Tommasini ..... F24C 15/327 126/21 A
6,016,820 A * 1/2000 Knoll ..... B08B 3/10 134/109

(Continued)

FOREIGN PATENT DOCUMENTS

DE 102004001224 B3 * 5/2005 ..... F24C 14/005
EP 1653155 A2 * 5/2006 ..... B08B 9/00

OTHER PUBLICATIONS

Chinese Office Action dated Jul. 3, 2015 for Chinese application No. 2012105243316.

(Continued)

*Primary Examiner* — Michael Barr
*Assistant Examiner* — Cristi Tate-Sims
(74) *Attorney, Agent, or Firm* — Ohlandt, Greeley, Ruggiero & Perle, LLP

(57) ABSTRACT

A cleaning system for cleaning a cavity of food or beverage preparation device. The cavity is connected with a pipe system. The pipe system supplies a fluid through the pipe system to the cavity. When the fluid flow stops, any remainder of the fluid in the pipe system is removed by passing a gas (for example, air) through the pipe system or by a valve disposed at a high location of the pipe system.

11 Claims, 9 Drawing Sheets

(56) References Cited

U.S. PATENT DOCUMENTS

| | | | | |
|---|---|---|---|---|
| 6,131,559 | A * | 10/2000 | Norris | A21B 1/245 126/21 A |
| 2010/0229899 | A1* | 9/2010 | Andersen | B08B 3/00 134/34 |
| 2013/0199511 | A1* | 8/2013 | Laessig | F24C 14/00 126/369 |

OTHER PUBLICATIONS

Chinese Office Action dated Jul. 29, 2016 for Chinese Application No. 2012105243316.
European Office Action dated Mar. 7, 2016 for European Application No. 12816335.9.
European Office Action dated Nov. 24, 2016 for European Application No. 12 816 335.9-1605.

* cited by examiner

CLEANING SYSTEM AND METHOD WITH AIR FLUSHING OF DETERGENT/RINSE PIPES

CROSS-REFERENCED APPLICATIONS

This application claims priority to PCT International Application No. PCT/IB2012/002717 filed on Dec. 14, 2012 and Provisional Application No. 61/619,167 filed on Apr. 2, 2012.

FIELD OF THE DISCLOSURE

This disclosure relates to a cleaning system and method for food or beverage preparation equipment.

BACKGROUND OF THE DISCLOSURE

Already known are cleaning systems for a food or beverage preparation cavity in which food or a beverage is prepared. Thus, in cooking ovens such as, convection and combi ovens, a cleaning detergent is sprayed into an oven cavity via a pump and pipe system. As shown in FIG. 1, a known cooking oven 20 comprises an enclosure 22 that defines an oven cavity 24. A cleaning system 26 includes a detergent reservoir 28 and a rinse reservoir 30 connected in a pipe system 32 via a detergent pump 34 and a neutralizer pump 36. Pipe system 32 is connected to a nozzle 38 and a rotor 40 in an upper part of oven cavity 24. With neutralizer pump 36 off, detergent pump 34 is turned on to supply detergent to oven cavity 24 via nozzle 38 and rotor 40. After a spray-in-phase, the detergent reacts with the soil and is then flushed with water via a separate pipe 42 and a water valve 46 via nozzles 44 and 48. In one of the last steps, with detergent pump 34 off, neutralizer pump 36 is turned on to supply neutralizer fluid so as to flush pipe system 32 with food safe rinse fluid (or also called neutralizer fluid) in order to get all detergent out of pipe system 32. This step is important, because if the detergent is not flushed, this fluid might drop out of pipe system 32 in the following cooking steps. All of the fluids and water exit the oven cavity 24 by a bottom drain hole 50 to a drain reservoir 52 and drain pipe 54.

A disadvantage of the cleaning system of the known cooking oven is that the pipe system, even after the rinse step, may still be filled because the pipe system is closed and does not allow the fluid to escape immediately. After a later cooking step this remaining fluid will thermally expand, thereby resulting in dripping.

SUMMARY OF THE DISCLOSURE

A cooking oven of the present disclosure comprises an enclosure that defines an oven cavity and a pipe system that supplies a first fluid and a second fluid to the oven cavity. A first reservoir and a second reservoir hold the first fluid and the second fluid, respectively. A first pump and a second pump are disposed in the pipe system to pump the first fluid and the second fluid to the oven cavity from the first and second reservoirs, respectively. A multiple position valve is disposed in the pipe system and has a first position to selectively connect the first and second pumps to the first and second reservoirs to pump the first fluid and the second fluid through the pipe system to the oven cavity. The multiple position valve has a second position in which a gas is pumped through the pipe system to remove any residual first fluid or second fluid from the pipe system.

In one embodiment of a cleaning system of the present disclosure, the cleaning system cleans a cavity in which food or beverage is prepared. The cleaning system comprises a pipe system that introduces a fluid into the cavity during a time interval and a device that is connected to the pipe system and that removes from the pipe system any remainder of the fluid remaining after the time interval.

In another embodiment of the cleaning system of the present disclosure, the device removes the remainder by introduction of a gas flow in the pipe system or by a valve positioned at a high location of the pipe system.

In another embodiment of the cleaning system of the present disclosure, the pipe system comprises a slanted section slanted downwardly toward or away from the cavity.

In another embodiment of the cleaning system of the present disclosure, the fluid comprises a first fluid and a second fluid. The first fluid and the second fluid are introduced into the pipe system during first and second time intervals, respectively. The device introduces the gas flow in the pipe system after the first time interval and/or after the second time interval.

In another embodiment of the cleaning system of the present disclosure, a first pump and a second pump are disposed in the pipe system to introduce the first and second fluids to the cavity, and a third pump is disposed to introduce the gas flow in the pipe system.

In another embodiment of the cleaning system of the present disclosure, one or more of the second and third pumps is reversible to effect the removal.

In another embodiment of the cleaning system of the present disclosure, the gas flow is supplied by a compressed gas system.

In another embodiment of the cleaning system of the present disclosure, the valve is selected from the group consisting of: mechanical, electrical and check.

In another embodiment of the cleaning system of the present disclosure, the cavity is an oven cavity of an oven for cooking food.

In another embodiment of the cleaning system of the present disclosure, the fluid is selected from the group consisting of: detergent, neutralizer, protection, flavor, liquid smoking, and delime.

In an embodiment of a method of the present disclosure, an oven cavity of a cooking oven is cleaned by:

introducing a first fluid into the oven cavity via a pipe system;

introducing into the pipe system a second fluid to rinse the cleaning fluid from the pipe system; and removing a remainder of the first and/or second fluids from the pipe system.

In another embodiment of the method of the present disclosure, the remainder is removed by introduction of a gas flow in into the pipe system or by a valve positioned at a high location of the pipe system.

In another embodiment of the method of the present disclosure, the pipe system comprises a slanted section slanted downwardly toward or away from the cavity.

In another embodiment of the method of the present disclosure, the gas flow is introduced into the pipe system following the step of introducing the first fluid and/or after the step of introducing the second fluid.

In another embodiment of the method of the present disclosure, a first pump and a second pump are disposed in the pipe system to introduce the first and second fluids to the oven cavity, and a third pump is disposed to introduce the gas flow into the pipe system.

In another embodiment of the method of the present disclosure, one or more of the second and third pumps is reversible to effect the removal.

In another embodiment of the method of the present disclosure, the gas flow is supplied by a compressed gas system.

In another embodiment of the method of the present disclosure, the valve is selected from the group consisting of: mechanical, electrical and check.

In another embodiment of the method of the present disclosure, the first and second fluids are selected from the group consisting of: detergent, neutralizer, protection, flavor, liquid smoking, and delime.

BRIEF DESCRIPTION OF THE DRAWINGS

Other and further objects, advantages and features of the present disclosure will be understood by reference to the following specification in conjunction with the accompanying drawings, in which like reference characters denote like elements of structure and.

DESCRIPTION OF THE PREFERRED EMBODIMENT

It is contemplated that the cleaning system and method of the present disclosure is useful to clean a cavity in which food or a beverage is prepared. However, by way of example, the cleaning system and method will be described herein in the context of a cooking oven.

Figure 1:
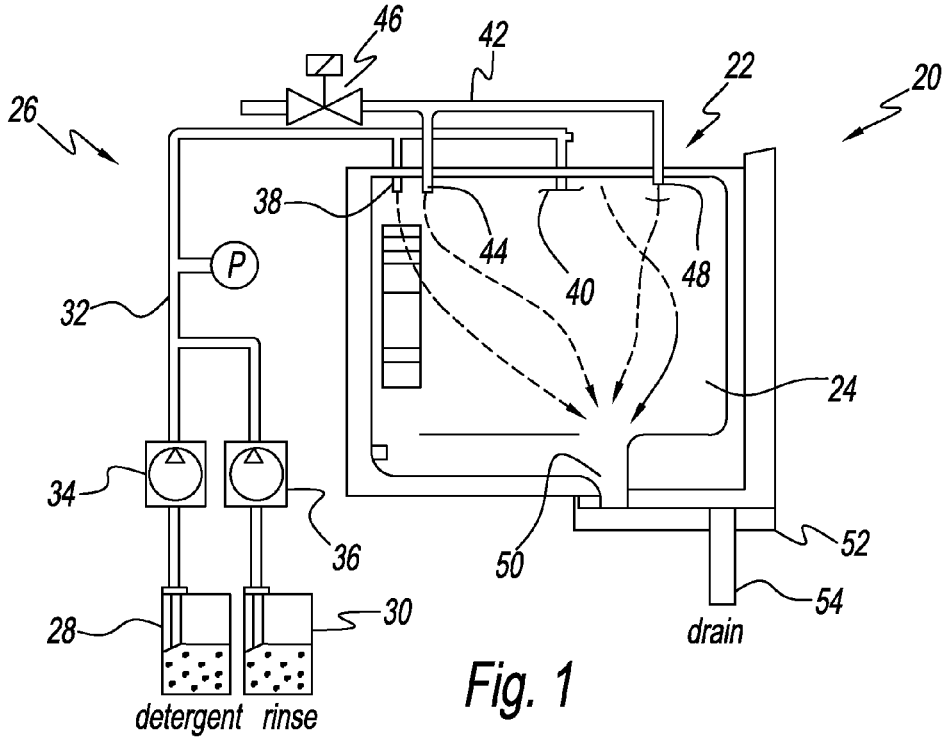
FIG. 1 is a diagram of a known cooking oven with a cleaning and rinsing system.
Figure 2:
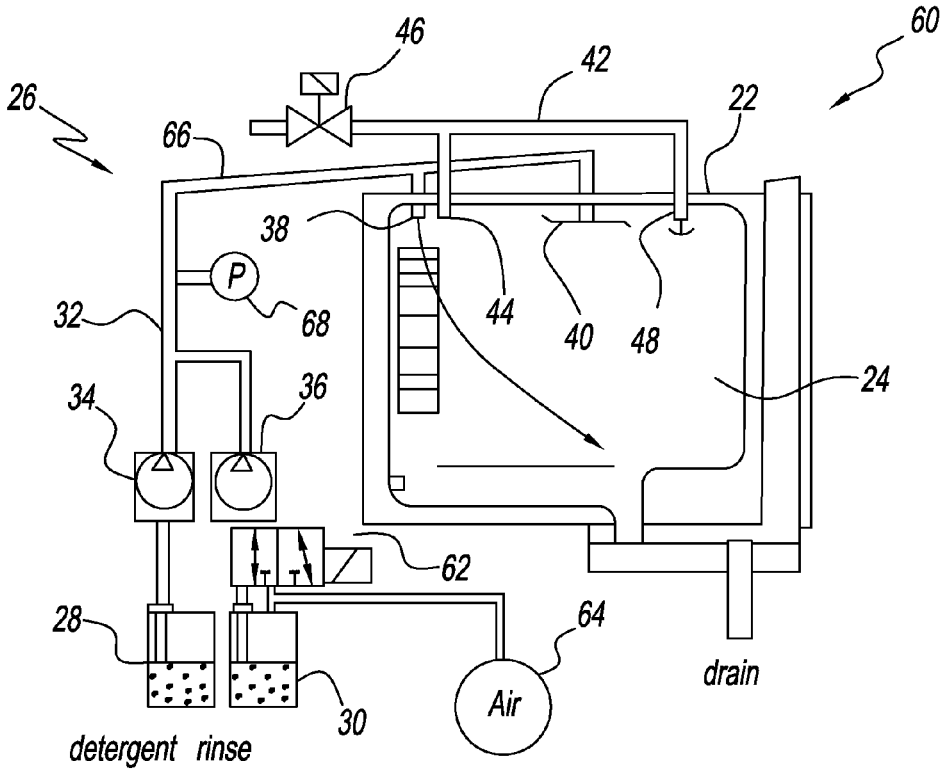
FIG. 2 is a diagram of a cooking oven with a cleaning and rinsing system according to the present disclosure.

Referring to FIG. 2, a cooking oven 60 according to the present disclosure includes many of the components of the known cooking oven 20 that are identified by the same names and/or reference numerals. Cooking oven 60 comprises a 3/2-way valve 62 that is connected to rinse reservoir 30, an air source 64 and pipe system 32. A pressure sensor 68 is connected to pipe system 32. The 3/2-way valve 62 is operated as follows. First, 3/2-way valve 62 is set to a "liquid"-position. In this position, pumps 34 and/or 36 can feed detergent during a first time interval in a first step and rinse fluid during a second time interval in a second step. In a third step, 3/2-way valve 62 is switched to an "air"-position. In this position pumps 34 and/or 36 are each operated to pump a gas flow (for example, air) through all of pipe system 32 and all remaining fluid is removed, purged or pushed out of pipe system 32 via nozzle 38 and rotor 40 toward and into oven cavity 24. A slanted section 66 of pipe system 32 from nozzle 38 and rotor 40 is slanted downwardly away from oven cavity 24 so that any remaining neutralizer fluid flows toward pumps 34 and 36.

Also, in an alternate embodiment, 3/2-way valve 62 can be operated in-between the cleaning and rinsing steps to remove, purge or push out the detergent before rinse pump 36 is activated so the whole volume which is already in pipe system 32 can be used in the active phase. So the overall chemical consumption can be reduced, thereby resulting in positive environmental impact and reduction of life cycle cost.

Figure 3:
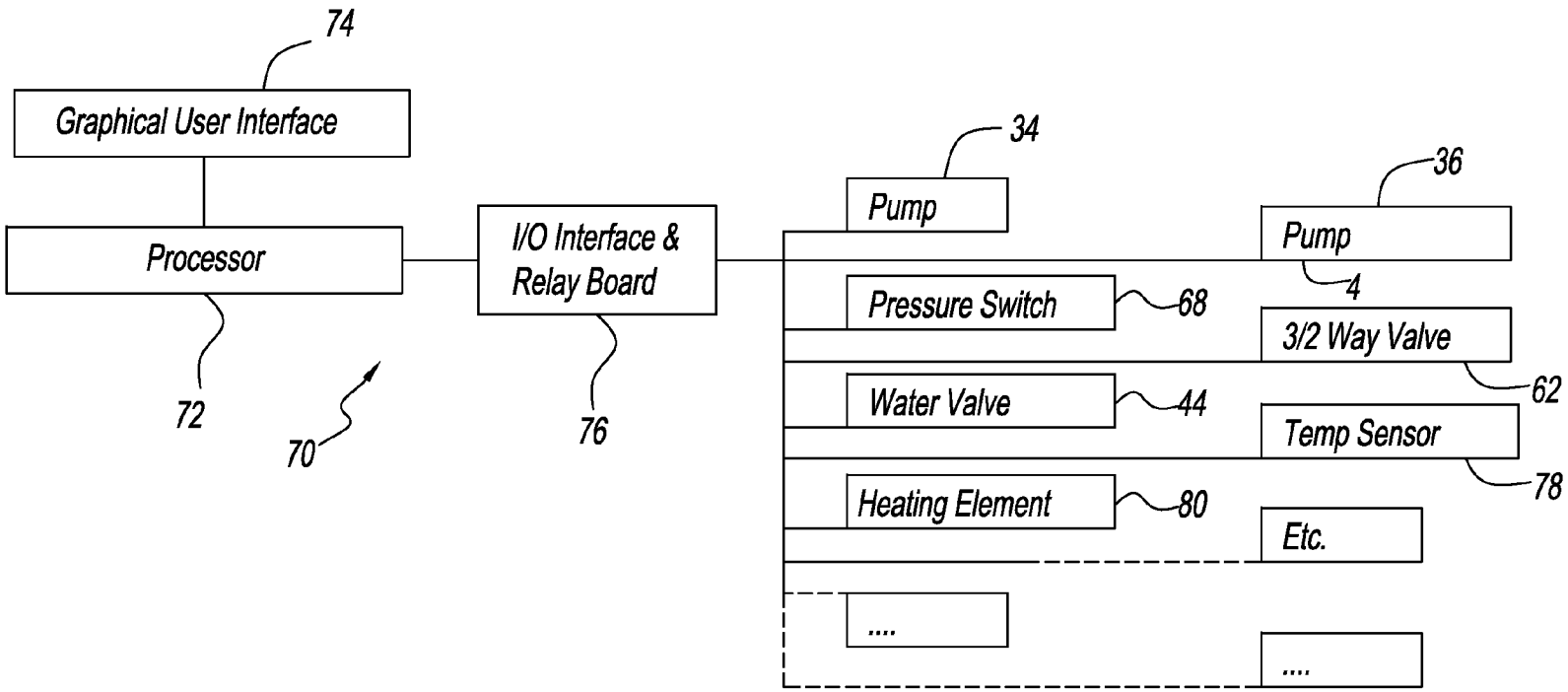
FIG. 3 is a block diagram of a controller that controls the cooking oven of FIG. 2.

Referring to FIG. 3, cooking oven 60 further comprises a controller 70 that includes a processor 72 that is interconnected with a graphical user interface 74 and an Input/Output (I/O) interface and relay board 76. I/O interface and relay board 76 has electrical connections with detergent pump 34, rinse pump 36, pressure switch 68, water valve 46, 3/2-way valve 62, a temperature sensor 78, a heating element 80 and other components (not shown) of cooking oven 60. Processor 72 executes a program stored in a memory (not shown) to control detergent pump 34 and rinse pump 36, water valve 46, and 3/2-way valve 62 in the manner described above.

Figure 4:
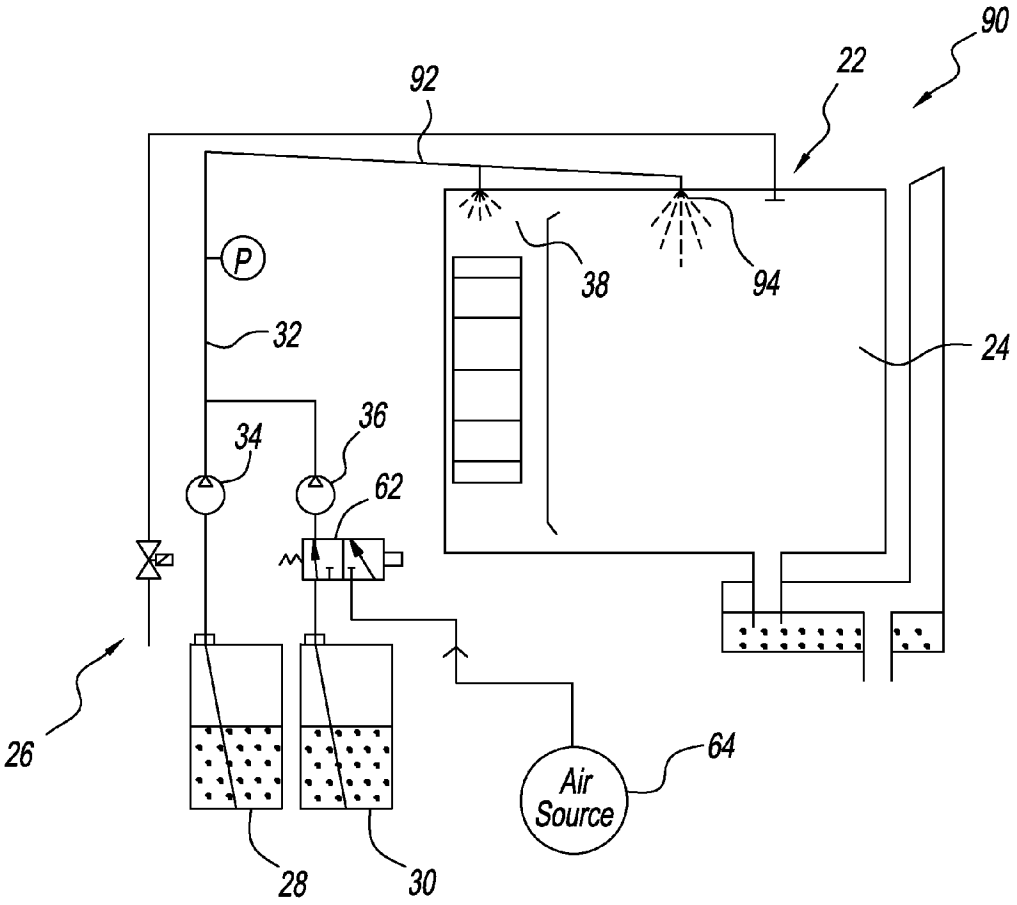
FIG. 4 is a diagram of another embodiment of the cooking oven according to the present disclosure.

Referring to FIG. 4, an alternate embodiment of the disclosure comprises a cooking oven 90 having components that correspond to components of cooking oven 60. Cooking oven 90 comprises enclosure 22, oven cavity 24, cleaning system 26 and controller 70 (shown in FIG. 3). Cleaning system 26 comprises pipe system 32, which comprises a slanted pipe section 92 that is sloped downwardly toward oven cavity 24 where it is connected to nozzle 38 and to a nozzle 94. In some embodiments, rotor 40 (FIG. 2) can be used in place of nozzle 94.

Controller 70 operates cleaning system 26 as follows. In a first step, detergent pump 34 is activated to pump detergent from detergent reservoir 28 through pipe system 32 and nozzles 38 and 94 to oven cavity 24. In a second step, detergent pump is turned off. The 3/2-way valve 62 is operated to connect air source 64 to remove or purge detergent from pipe system 32 to oven cavity 24. After detergent pump 34 is turned off, any residual detergent left in pipe section 92 flows by gravity through nozzles 38 and 94 into oven cavity 24.

In a third step, 3/2-way valve 62 is operated to connect to rinse pump 36. Rinse pump 36 is then activated to pump rinse fluid from rinse reservoir 30 through pipe system 32 and nozzles 38 and 94 to oven cavity 24. In a fourth step, the 3/2-way valve 62 is operated to disconnect from rinse reservoir and connect to air source 64 to provide a gas flow toward oven cavity 24 and to remove or purge rinse fluid from pipe system 32 to oven cavity 24. After rinse pump 34 is turned off, any residual rinse fluid left in pipe section 92 flows by gravity through nozzles 38 and 94 into oven cavity 24.

Figure 5:
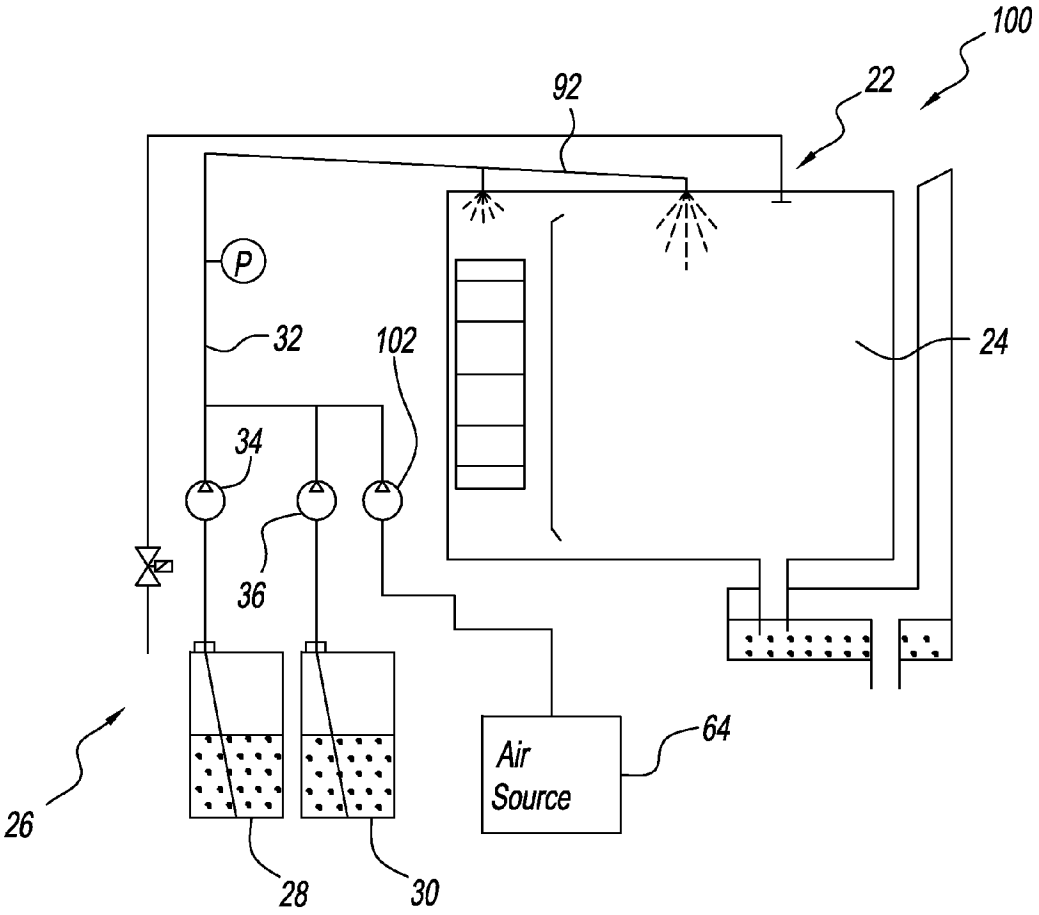
FIG. 5 is a diagram of a further embodiment of the cooking oven according to the present disclosure.

Referring to FIG. 5, an alternate embodiment of the disclosure comprises a cooking oven 100 having components that correspond to components of cooking oven 60. Cooking oven 100 comprises enclosure 22, oven cavity 24, cleaning system 26 and controller 70 (shown in FIG. 3). Cleaning system 26 differs from cooking oven 60 by eliminating the 3/2-way valve. Instead, rinse reservoir 30 is connected directly to rinse pump 36 and a separate pump 102 connects air source 64 directly to pipe system 32. In operation, controller 70 operates detergent pump 34 and rinse pump 36 to supply detergent and rinse fluid via pipe system 32 to oven cavity 24 as described above. At the end of a detergent step and at the end of a rinse step, controller 70 operates pump 102 to provide the flow of air through pipe system 32 toward oven cavity 24 to remove or purge any residual detergent or rinse fluid from pipe system 32 into oven cavity 24.

Figure 6:
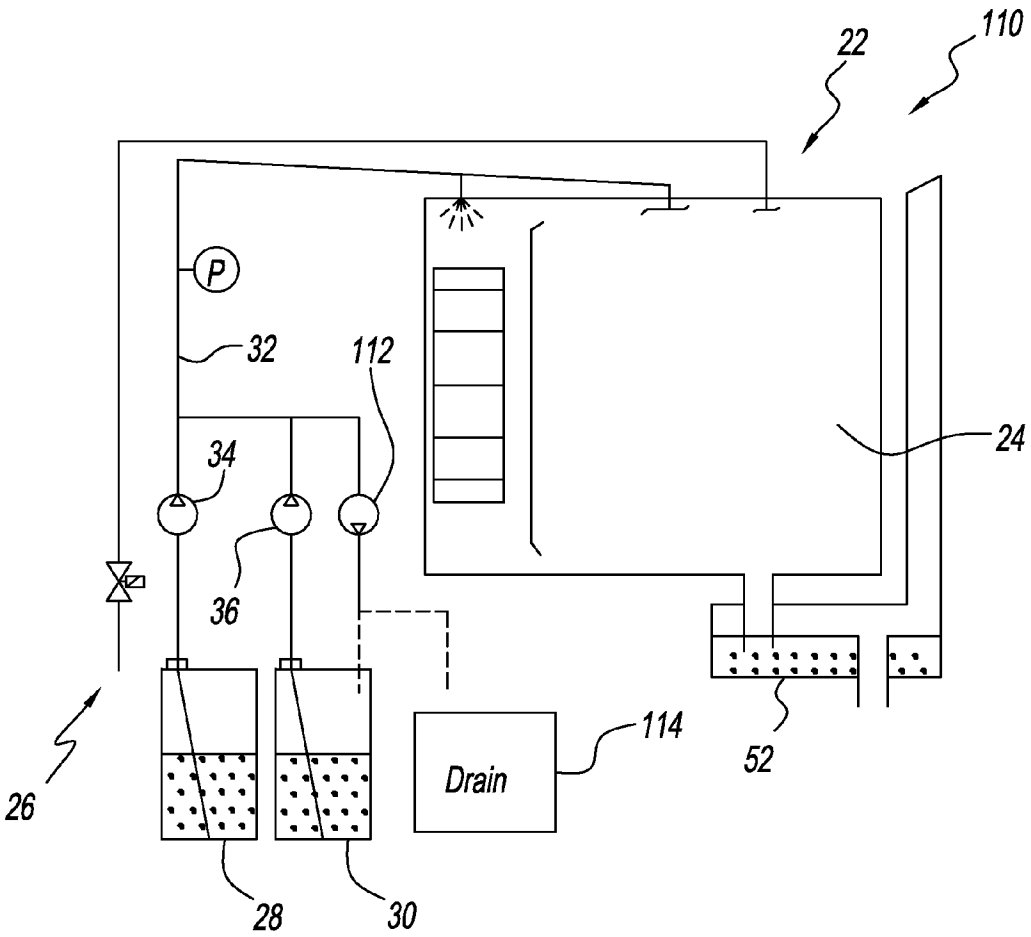
FIG. 6 is a diagram of a further embodiment of the cooking oven according to the present disclosure.

Referring to FIG. 6, an alternate embodiment of the disclosure comprises a cooking oven 110 having components that correspond to components of cooking oven 60. Cooking oven 110 comprises enclosure 22, oven cavity 24, cleaning system 26 and controller 70 (shown in FIG. 3). Cleaning system 26 differs from cooking oven 60 by eliminating the 3/2-way valve. Instead, rinse reservoir 30 is connected directly to rinse pump 36 and a separate suction pump 112 connects directly to pipe system 32.

In operation, controller 70 operates detergent pump 34 and rinse pump 36 to supply detergent and rinse fluid via pipe system 32 to oven cavity 24 as described above. At the end of a detergent step and at the end of a rinse step, controller 70 operates pump 112 to provide a gas flow away from oven cavity 24 and to remove by suction or pulling any residual detergent or rinse fluid from pipe system 32 to rinse reservoir 30 or to a drain 114. Optionally, the removed detergent or rinse fluid could be conveyed by a conduit (not shown) to drain 52.

Figure 7:
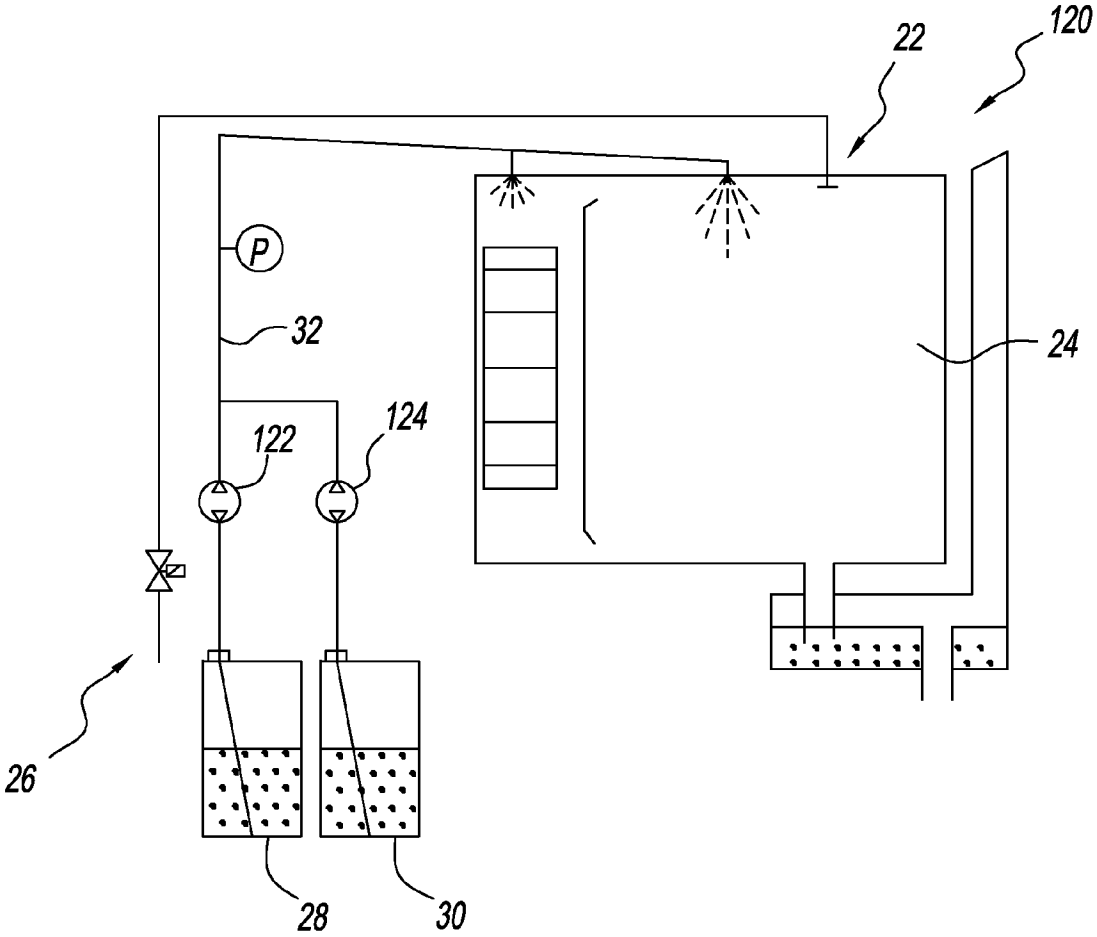
FIG. 7 is a diagram of a further embodiment of the cooking oven according to the present disclosure.

Referring to FIG. 7, an alternate embodiment of the disclosure comprises a cooking oven 120 having components that correspond to components of cooking oven 60. Cooking oven 120 comprises enclosure 22, oven cavity 24, cleaning system 26 and controller 70 (shown in FIG. 3). Cleaning system 26 differs from cooking oven 60 by eliminating the 3/2-way valve and by replacing one way detergent pump 34 and one way rinse pump 36 with a reversible detergent pump 122 and a reversible rinse pump 124, respectively. In operation, controller 70 operates reversible detergent pump 122 and reversible rinse pump 124 to supply detergent and rinse fluid via pipe system 32 to oven cavity 24 as described above. At the end of a detergent step and at the end of a rinse step, controller 70 operates reversible detergent pump 122 and reversible rinse pump 124 to remove or purge by suction any residual detergent or rinse fluid from pipe system 32 to detergent reservoir 28 and to rinse reservoir 30, respectively.

Figure 8:
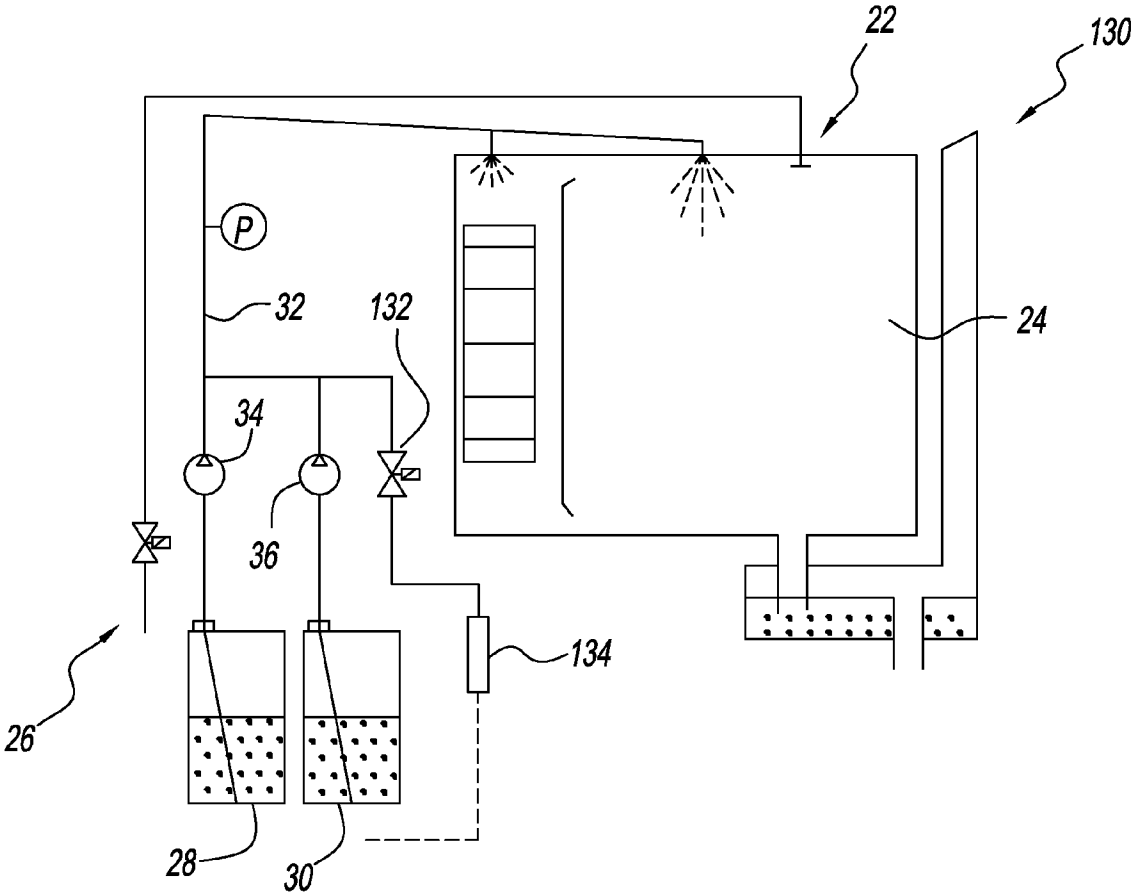
FIG. 8 is a diagram of a further embodiment of the cooking oven according to the present disclosure.

Referring to FIG. 8, an alternate embodiment of the disclosure comprises a cooking oven 130 having components that correspond to components of cooking oven 60. Cooking oven 110 comprises enclosure 22, oven cavity 24, cleaning system 26 and controller 70 (shown in FIG. 3). Cleaning system 26 differs from cooking oven 60 by eliminating the 3/2-way valve. Instead, rinse reservoir 30 is connected directly to rinse pump 36. A valve 132 connects pipe system 32 to a compressed air device 134. In operation, controller 70 operates detergent pump 34 and rinse pump 36 to supply detergent and rinse fluid via pipe system 32 to oven cavity 24 as described above. At the end of a detergent step and at the end of a rinse step, controller 70 operates valve 132 to connect pipe system 32 to provide a gas flow in pipe system 32 away from oven cavity 24 to compressed air device 134. Compressed air device 134 is operable to remove or purge by suction any residual detergent or rinse fluid from pipe system 32 to a drain (not shown). Compressed air device, for example, may be an air compressor located in a building in which oven 130 is situated.

Figure 9:
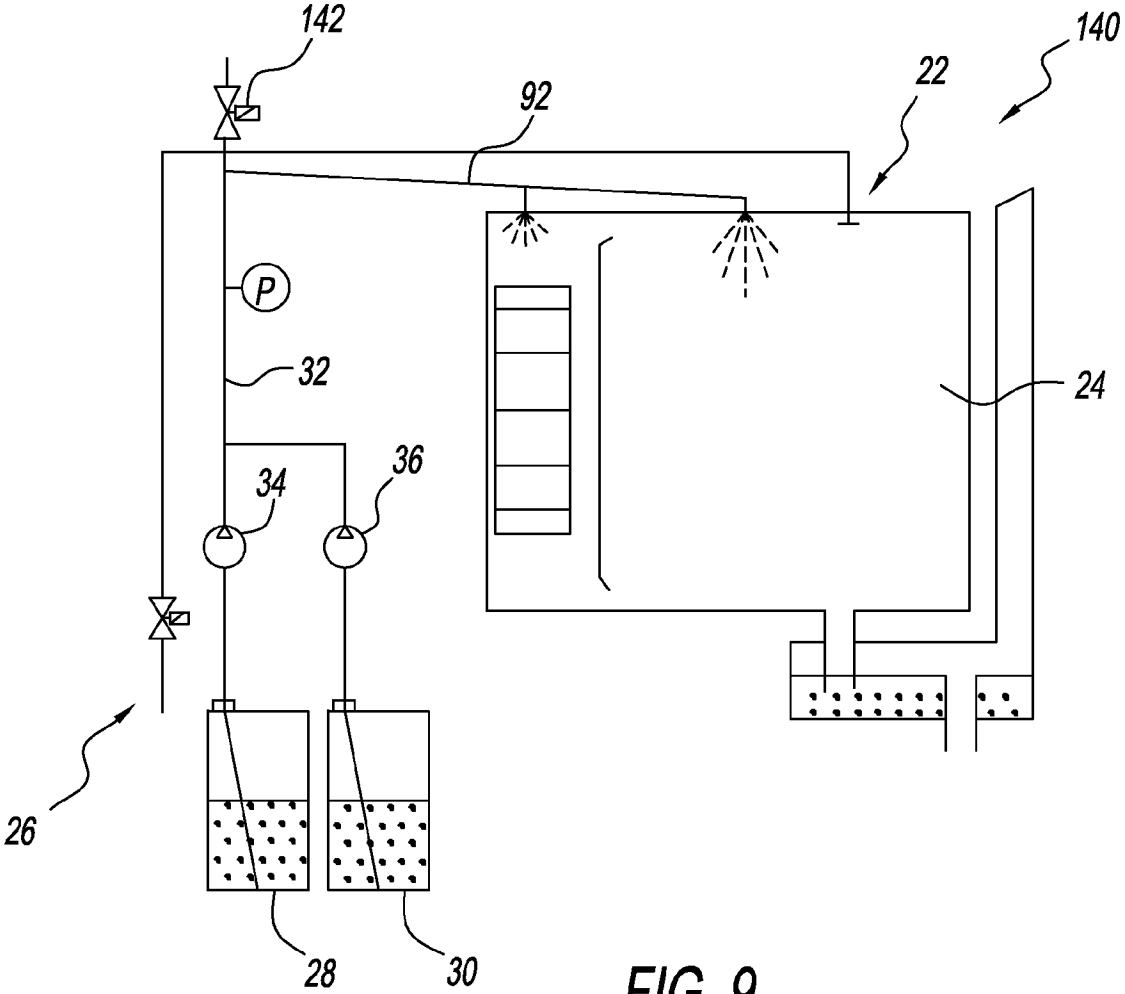
FIG. 9 is a diagram of a further embodiment of the cooking oven according to the present disclosure.

Referring to FIG. 9, an alternate embodiment of the disclosure comprises a cooking oven 140 having components that correspond to components of cooking oven 60. Cooking oven 140 comprises enclosure 22, oven cavity 24, cleaning system 26 and controller 70 (shown in FIG. 3). Cleaning system 26 differs from cooking oven 60 by eliminating the 3/2-way valve. Instead, rinse reservoir 30 is connected directly to rinse pump 36. A valve 142 is connected to pipe system 32. In operation, controller 70 operates valve 142 to a closed position and detergent pump 34 and rinse pump 36 to supply detergent and rinse fluid via pipe system 32 to oven cavity 24 as described above. At the end of a detergent step and at the end of a rinse step, controller 70 operates valve 142 to an open position, which opens the upper section of pipe section 92. This allows liquid to drain from pipe section 92 via gravity. If valve 142 is closed, liquid cannot drain from pipe section 92. When valve 142 is opened, there is zero pressure at the high point of pipe section 92 that assists in purging pipe section 92 of any residual detergent or rinse fluid from pipe section 92 to oven cavity 24

Figure 10:
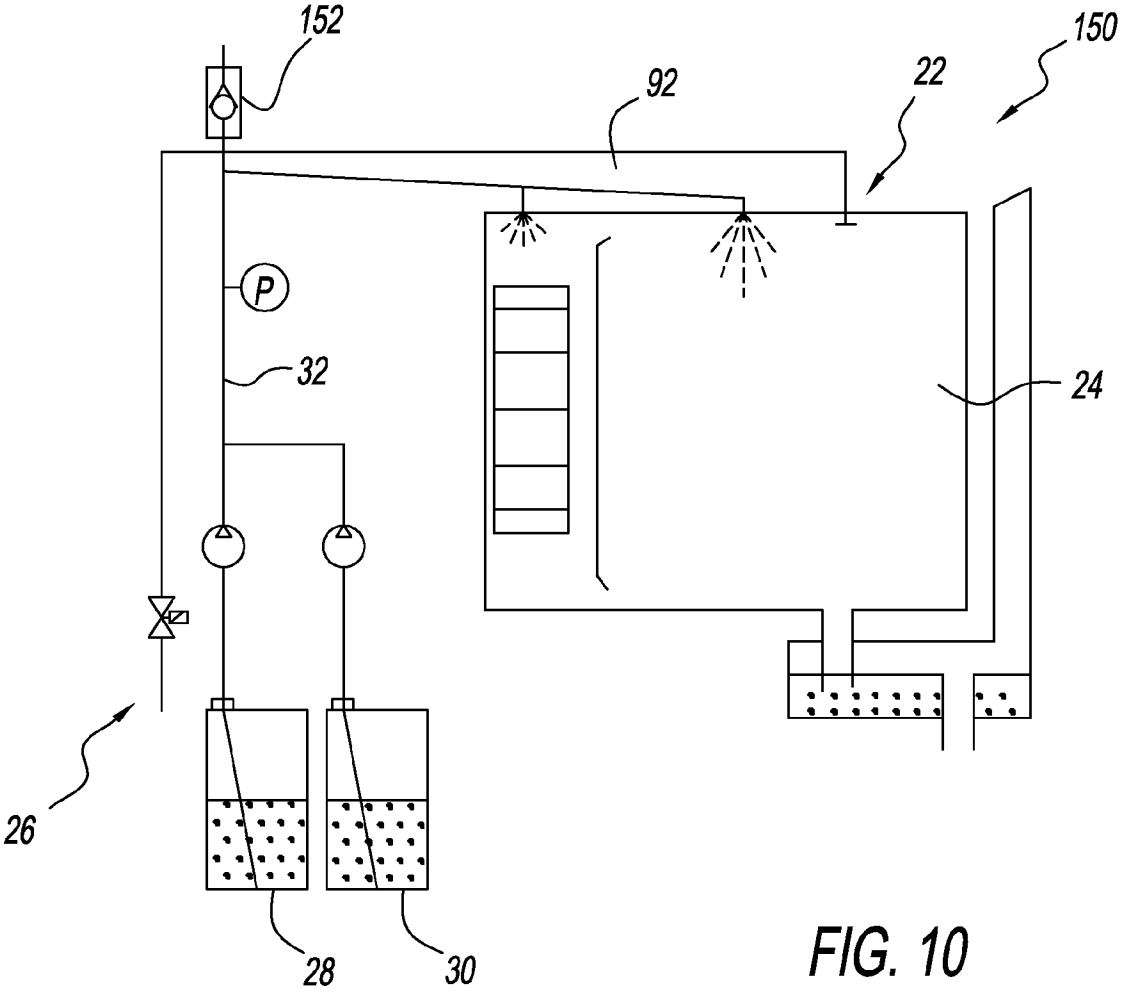
FIG. 10 is a diagram of a further embodiment of the cooking oven according to the present disclosure.

Referring to FIG. 10, an alternate embodiment of the disclosure comprises a cooking oven 150 having components that correspond to components of cooking oven 60 and cooking oven 140. Cooking oven 150 comprises enclosure 22, oven cavity 24, cleaning system 26 and controller 70 (shown in FIG. 3). Cleaning system 26 differs from cooking oven 140 by replacing valve 142 with a check valve 152. In operation, controller 70 operates detergent pump 34 and rinse pump 36 to supply detergent and rinse fluid via pipe system 32 to oven cavity 24 as described above. During the detergent and rinse steps, check valve 152 is closed due to pressure of liquid flow in pipe section 92. At the end of a detergent step and at the end of a rinse step, check valve 152 opens by gravity or spring force. This opens pipe section 92 so that any residual detergent or rinse fluid is removed, purged or drained via gravity from pipe section 92 to oven cavity 24.

The present disclosure having been thus described with particular reference to the preferred forms thereof, it will be obvious that various changes and modifications may be made therein without departing from the spirit and scope of the present disclosure as defined in the appended claims.

What is claimed is:

1. A cleaning system for cleaning a cavity in which food or beverage is prepared, said cleaning system comprising:

a first fluid reservoir in fluid communication with said cavity via a first conduit and first pump, said first reservoir containing a first fluid, said first fluid introduced into said cavity via said first conduit and said first pump, wherein a length of said first conduit external to said cavity and disposed above a top portion of said cavity is slanted downwardly toward or away from said cavity;

a second fluid reservoir in fluid communication with said cavity via a second conduit, a second pump and said first conduit, said second conduit connected directly to said first conduit, said second reservoir containing a second fluid, said second fluid introduced into said cavity via said second conduit, said second pump and said first conduit; and a valve disposed in said second conduit, wherein said valve shuts off the flow of said second fluid from said second reservoir into said second conduit and allows a flow of a purge gas from a gas source through said second conduit, said first conduit and into said cavity, and wherein said purge gas removes residual first and/or second fluid disposed in said first and second conduits.

2. The cleaning system of claim 1, wherein said first fluid and said second fluid are introduced into said pipe system during first and second time intervals, respectively, and wherein said purge gas is introduced into said pipe system after said first time interval and/or after said second time interval.

3. The cleaning system of claim 1, wherein said purge gas is supplied by a compressed gas system.

4. The cleaning system of claim 1, wherein said cavity is an oven cavity for cooking food.

5. The cleaning system of claim 1, wherein said first or said second fluid is selected from the group consisting of: detergent, neutralizer, protection, flavor, liquid smoking, and delime.

6. A cleaning system for cleaning a cavity in which food or beverage is prepared, said cleaning system comprising:

a first fluid reservoir in fluid communication with said cavity via a first conduit and a first pump, said first reservoir containing a first fluid, said first fluid introduced into said cavity via said first conduit and said first pump, wherein a length of said first conduit external to said cavity and disposed above a top portion of said cavity is slanted downwardly toward or away from said cavity;

a second fluid reservoir in fluid communication with said cavity via a second conduit, a second pump and said first conduit, said second conduit connected directly to said first conduit, said second reservoir containing a second fluid, said second fluid introduced into said cavity via said second conduit, said second pump and said first conduit; and a third conduit disposed between said cavity and a component selected from the group consisting of said second fluid reservoir, a purge gas source and a drain pipe system, said third conduit in fluid communication with said cavity via a third pump, said second conduit and said first conduit, wherein residual first and/or second fluid disposed in said first and second conduits is removed either by (a) gas flow away from said purge gas source toward said cavity via said third pump, or (b) by suction away from said cavity toward said second reservoir or said drain pipe system via said third pump.

7. The cleaning system of claim 6, wherein said cavity is an oven cavity for cooking food.

8. The cleaning system of claim 6, wherein said first and second fluids are at least one selected from the group consisting of: detergent, neutralizer, protection, flavor, liquid smoking, and delime.

9. A cleaning system for cleaning a cavity in which food or beverage is prepared, said cleaning system comprising:

a first fluid reservoir in fluid communication with said cavity via a first conduit and a first reversible pump, said first reservoir containing a first fluid, said first fluid introduced into said cavity via said first conduit and said first reversible pump, wherein a length of said first conduit external to said cavity and disposed above a top portion of said cavity is slanted downwardly toward or away from said cavity;

a second fluid reservoir in fluid communication with said cavity via a second conduit, a second reversible pump and said first conduit, said second conduit connected directly to said first conduit, said second reservoir containing a second fluid, said second fluid introduced into said cavity via said second conduit, said second pump and said first conduit, wherein residual first and/or second fluid disposed in said first and second conduits is removed by said first reversible pump and said second reversible pump, respectively.

10. A cleaning system for cleaning a cavity in which food or beverage is prepared, said cleaning system comprising:

a first fluid reservoir in fluid communication with said cavity via a first conduit and a first pump, said first reservoir containing a first fluid, said first fluid introduced into said cavity via said first conduit and said first pump, wherein a length of said first conduit external to said cavity and disposed above a top portion of said cavity is slanted downwardly toward or away from said cavity;

a second fluid reservoir in fluid communication with said cavity via a second conduit, a second pump and said first conduit, said second conduit connected directly to said first conduit, said second reservoir containing a second fluid, said second fluid introduced into said cavity via said second conduit, said second pump and said first conduit; and a valve disposed above said cavity in fluid communication with said first conduit, wherein said valve is closed when said first and/or said second fluid are introduced into said cavity, and wherein residual first and/or second fluid disposed in said first and second conduits is removed by gravity by opening said valve.

11. The cleaning system of claim 10, wherein said valve is at least one selected from the group consisting of: mechanical, electrical and check valves.

* * * * *